US010190068B2

(12) United States Patent
Sheng et al.

(10) Patent No.: US 10,190,068 B2
(45) Date of Patent: Jan. 29, 2019

(54) GIANT ELECTRORHEOLOGICAL FLUID SURFACTANT ADDITIVES

(71) Applicant: The Hong Kong University of Science and Technology, Hong Kong (CN)

(72) Inventors: Ping Sheng, Hong Kong (CN); Maijia Liao, Hong Kong (CN); Weijia Wen, Hong Kong (CN); Ya Ying Hong, Hong Kong (CN)

(73) Assignee: THE HONG KONG UNIVERSITY OF SCIENCE AND TECHNOLOGY, Hong Kong (CN)

( * ) Notice: Subject to any disclaimer, the term of this patent is extended or adjusted under 35 U.S.C. 154(b) by 0 days.

(21) Appl. No.: 14/590,533

(22) Filed: Jan. 6, 2015

(65) Prior Publication Data

US 2016/0168501 A1 Jun. 16, 2016

Related U.S. Application Data

(60) Provisional application No. 61/964,636, filed on Jan. 10, 2014.

(51) Int. Cl.
*C10M 135/10* (2006.01)
*C10M 125/18* (2006.01)
(Continued)

(52) U.S. Cl.
CPC ..... *C10M 135/10* (2013.01); *C10M 125/18* (2013.01); *C10M 133/20* (2013.01);
(Continued)

(58) Field of Classification Search
CPC ..... C10M 133/20; C10M 135/10; C09K 5/08
(Continued)

(56) References Cited

U.S. PATENT DOCUMENTS 5,032,307 A 7/1991 Carlson
5,558,803 A 9/1996 Okada
(Continued)

FOREIGN PATENT DOCUMENTS

CN 1298821 C 2/2007
CN 101531945 A 9/2009
CN 102660352 B 11/2013

OTHER PUBLICATIONS

Shen et al. "TiO2 based electrorheological fluid with high yield stress", International Journal of Moder Physics B, 19(7, 8 and 9), 2005, 1104-1109.*
Bleza et al. "electrorheological and dielectric properties of urea/SiO2 nanocomposite suspensions modified by N,N-dimethylformamide", International Journal of Modern Physics B, 21 (28 and 29), (2007), 4782-4789.*
(Continued)

*Primary Examiner* — Jane L Stanley
(74) *Attorney, Agent, or Firm* — Nath, Goldberg & Meyer; Joshua B. Goldberg; Tanya E. Harkins

(57) ABSTRACT

GER fluids are improved by the addition of a polar molecule additive. By addition of a polar molecule additive, yield stresses under electric field are improved by over 50% while the current density is reduced to less than a quarter of the original GER. The reversible response time still remains the same, and the sedimentation stability is greatly enhanced. The zero field viscosity of the modified GER fluid remains the same as that of the original GER fluid without the additive. The improved GER characteristics improve general functionality as an electrical-mechanical interface, attendant with applications to car clutches, fluid brakes, and vehicle shock absorbers.

3 Claims, 5 Drawing Sheets

(51) Int. Cl.
*C10M 133/20* (2006.01)
*C10M 141/08* (2006.01)
*C10M 171/00* (2006.01)

(52) U.S. Cl.
CPC ..... *C10M 141/08* (2013.01); *C10M 171/001* (2013.01); *C10M 2201/14* (2013.01); *C10M 2203/1006* (2013.01); *C10M 2207/289* (2013.01); *C10M 2207/401* (2013.01); *C10M 2209/104* (2013.01); *C10M 2209/109* (2013.01); *C10M 2215/04* (2013.01); *C10M 2215/042* (2013.01); *C10M 2215/102* (2013.01); *C10M 2215/223* (2013.01); *C10M 2219/042* (2013.01); *C10M 2219/044* (2013.01); *C10M 2229/025* (2013.01); *C10N 2210/02* (2013.01); *C10N 2230/02* (2013.01); *C10N 2230/04* (2013.01); *C10N 2230/60* (2013.01); *C10N 2240/04* (2013.01); *C10N 2240/08* (2013.01); *C10N 2240/10* (2013.01)

(58) Field of Classification Search
USPC ..... 252/73
See application file for complete search history.

(56) References Cited

U.S. PATENT DOCUMENTS

| | | | | |
|---|---|---|---|---|
| 5,558,811 | A | 9/1996 | Pialet | |
| 6,852,251 | B2 * | 2/2005 | Sheng | C10M 171/001 252/500 |
| 2005/0285085 | A1 * | 12/2005 | Wen | C10M 171/001 252/518.1 |

OTHER PUBLICATIONS

Liu et al. "Optically transparent electrorheological fluid with urea-modified silica nanopartilces and its haptic display application", Journal of Colloid and Interface Science, 404 (May 2013), 56-61.*
Zhao et al. "Nano titanium oxide organosol: synthesis, characterization, and application for electrorheological fluid", Journal of Applied Polymer Science, 110, 3793-3769 (2008).*
Wen et al., "The giant electrorheological effect in suspensions of nanoparticles", Nature Materials, vol. 2, Nov. 2003.
Li et al., "Giant electrorheological fluid comprising nanoparticles: Carbon nanotube composite", Journal of Applied Physics, vol. 107, No. 093507, 2010.

* cited by examiner

GIANT ELECTRORHEOLOGICAL FLUID SURFACTANT ADDITIVES

CROSS-REFERENCE TO RELATED APPLICATION

This application claims priority to U.S. provisional application Nos. 61/964,636 filed Jan. 10, 2014.

BACKGROUND

The present subject matter relates to electrorheological fluids and the role of particle-fluid wetting surfactants in inducing the electrorheological effect formed by particles in fluid suspension. Of particular interest is the role of particle-fluid wetting surfactants in lowering sedimentation rates.

Electrorheological (ER) fluids are a type of colloidal suspensions, comprising micro-particles or nanoparticles dispersed in non-conducting oil. The rheological properties (apparent viscosity) of ER fluids can be continuously and reversibly adjusted from fluid to solid and back again in response to an electric field. Specifically, under application of a 1-5 kV/mm field, ER fluids will exhibit solid-like behavior, such as the ability to transmit shear stress. The transition time from liquid-like behavior to solid-like behavior can occur on the order of 1 to 10 ms. This phenomenon is known as the ER effect, and this change in apparent viscosity is dependent on the applied electrical field. The change is not a simple viscosity change. Instead, the ER effect is more correctly defined as an electric field dependent shear yield stress, wherein the yield point of the ER fluid is determined by the electric field strength. After the yield point is reached, the fluid shears as a fluid, and consequently the resistance to motion of the ER fluid can be controlled by adjusting the applied electric field.

One problem encountered with ER fluids is that the yield strength is too low for many practical applications. The yield stress of known ER fluids is typically not more than 5 kPa at 3 kV/mm which is inadequate for most of the potential uses of ER fluids. A further problem is the tendency for ER fluids to undergo sedimentation.

The discovery of the giant ER (GER) effect was realized by using urea-coated nanoparticles and has broken the theoretical upper limits of the traditional ER effect. With a controllable solid-liquid phase transition having a reversible response time of <10 ms, GER fluids can sustain higher yield stress over many other ER fluids. Despite improved performance, GER fluids still display stability issues with respect to particle sedimentation, and thus have not improved upon this aspect of ER fluids, generally.

Various attempts at improvements to these drawbacks to ER and GER fluids have been made. Adding surfactant to the solvent phases or making the particle less dense can either decrease the density mismatch or modify the surface or particle morphology, or both. While surfactants have been shown to improve the sedimentation property of the GER fluids, they tend to generally lower the GER effect and required a current density increase as a result. Previous experiments conducted with GER fluids indicate the activity of a surfactant depends strongly on its polarity. Lipophilic surfactants stabilized the suspension but at the expense of about 30% decrease in the yield stress, simultaneous with a reduction in the current density. Hydrophilic surfactants hardly stabilized the suspension but an increase of yield stress was observed that was not accompanied by an increase in current density.

Shen et al. (*Wetting-induced Electrorheological Effect*, J. Appl. Phys. 99, 106104 (2006)) demonstrated that by adding a small amount of oleic acid to nanoparticles of barium titanyl oxalate coated with urea suspended in hydrocarbon oil produced a high yield stress. However, this dramatic increase of the dynamic yield stress also coincided with a sharp increased current density. Likewise, Li et al. (Giant Electrorheological Fluid Comprising Nanoparticles: Carbon Nanotube Composite, J. Appl. Phys. 107, 093507 (2010)) added oxide-carbon nanotube composites to the synthesis of urea-coated particles. The particles, when dispersed in different types of silicone oil, were shown to have enhanced anti-sedimentation property. The yield stress, however, has shown a 10% reduction.

Carlson, in U.S. Pat. No. 5,032,307, attempts to bypass sedimentation problems by using a surfactant as the particle component of an ER fluid; Carlson teaches water-miscible electrorheological materials containing a carrier fluid, a combined non-abrasive, anionic surfactant-particle component, and an activator.

Okada et al., in U.S. Pat. No. 5,558,803, discloses an ER fluid capable of generating a large shear stress while exhibiting excellent current property and durability. Okada et al. rely on dielectric particles and a dielectric particle absorbing structure.

Pialet et al., in U.S. Pat. No. 5,558,811, discloses good dispersive stability by use of an aromatic hydroxyl compound substituted with a hydrocarbyl group containing at least 6 carbon atoms in a carbon-based hydrophobic base fluid.

In an effort to overcome the drawbacks of known ER and GER fluids, the present subject matter is directed to compositions and methods for introducing surfactant additives to GER fluids that enhance stability without the usual drawbacks. Specifically, the instant subject matter seeks to circumvent the known restriction that increased yield stress is accompanied by increased current density. Accordingly, by adding a polar molecule additive, the inventors have found that dynamic yield stress can be enhanced over 50%, while the current density is reduced dramatically. The reversible response time remains the same and the sedimentation stability is greatly enhanced. Long-term reliability problems are reduced as a result of the low sedimentation rates and improved redispersion rated in the fluids. The improved GER fluid is expected to facilitate its application in car clutches, fluid brakes, and vehicle shock absorbers, etc.

BRIEF SUMMARY

The present subject matter addresses the above problems and is directed to an improved electrorheological (GER) fluid comprising: metal salt nanocomposite coated with urea; a polar molecule additive; and a high wetting insulating liquid. The metal salt nanocomposite is suspended in the high wetting insulating liquid.

In another aspect of the present subject matter, the polar molecule additive of the improved ER fluid is selected from the group consisting anionic surfactants, cationic surfactants and nonionic surfactants. In a further aspect of the present subject matter, the urea coating of the nanocomposite is present in an amount of 0.1 to 1.0 weight percent of the nanocomposite.

A still further aspect of the present subject matter, is directed to a method for improving giant electrorheological (GER) fluids The method includes the steps of: providing for a GER fluid, prepared by steps comprising: grinding a composite consisting of urea-coated nanoparticles and 0.2-

5.0 wt % sodium dodecylbenzenesulfate (SDBS); agitating the ground composite via ultrasonification for at least 30 minutes at 20-40 ° C.; drying the composite fir at least 12 hours in a freeze drying machine; and suspending the agitated, ground composite in a non-conducting oil.

DESCRIPTION OF THE DRAWINGS

FIG. 1 (*b*) depicts viscosity measured with no external field applied under velocity $\dot{\gamma}$=0.1 rad/s.

FIG. 1 (*c*) depicts current density under an external applied field 1 KV/mm with angular velocity $\dot{\gamma}$=0.1 rad/s.

FIG. 2 (*b*) depicts a sample without SDBS addition after 10 hours of rotation with the same angular speed of $\dot{\gamma}$=0.4 rad/s.

DETAILED DESCRIPTION

Figure 1A:
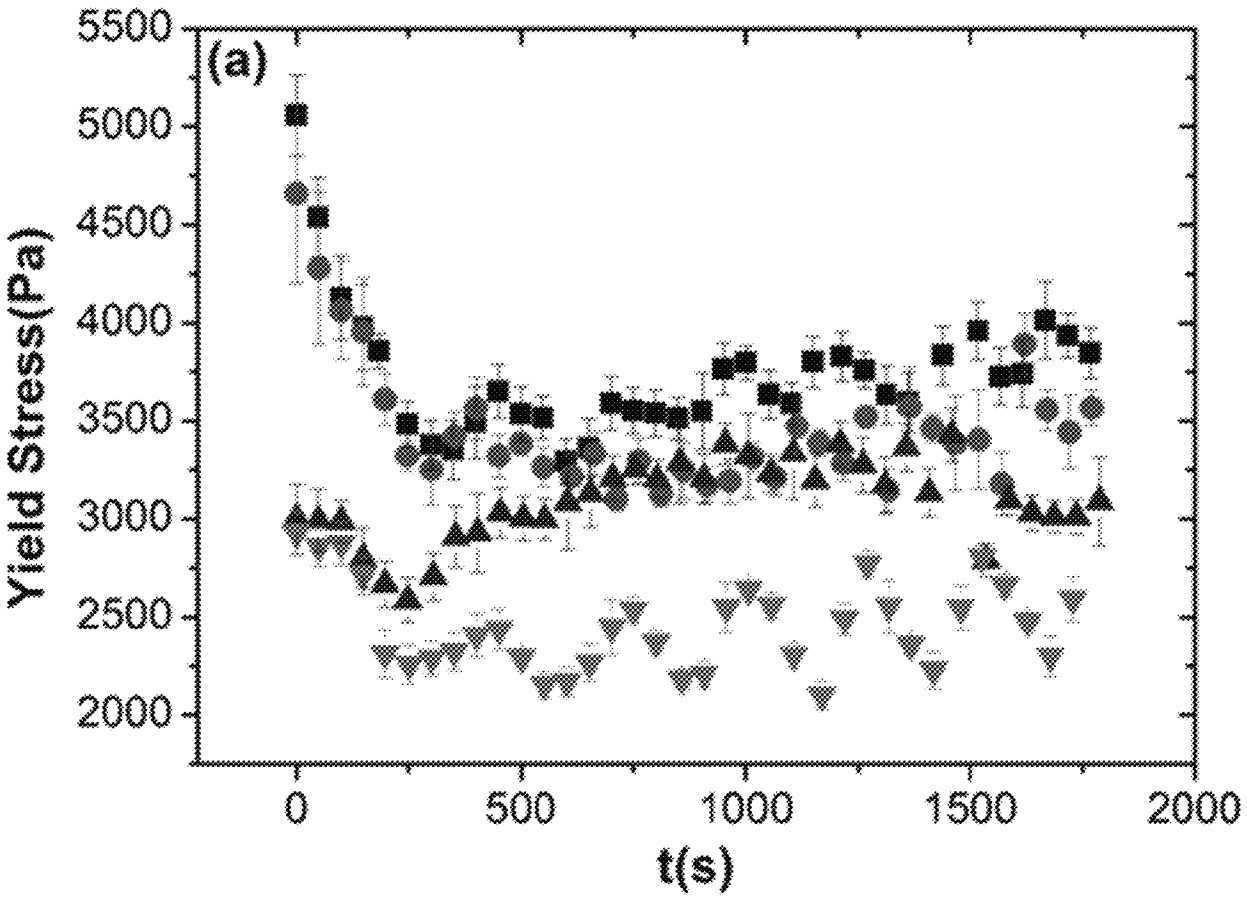
FIG. 1 (*a*) depicts the dynamic yield stress under an external applied field of 1 KV/mm with angular velocity $\dot{\gamma}$=0.1 rad/s. Here ● is for sample with 0.2 wt % SDBS addition, ▪ is for sample with 1 wt % SDBS addition, ▲ is for sample with 5 wt % SDBS addition, ♥ is for sample with no surfactant addition.

This subject matter relates to the modification of sedimentation properties and redispersing behavior of GER urea-coated nanoparticles and enhancement of the ER effect through the incorporation of polar molecule additives into metal salt nanoparticle composites structures (nanocomposites). The present fluids and methods are capable of generating large shear stresses while maintaining a good sedimentation rate when under an applied electric field. A still further aspect the present subject matter provides a method of manufacturing composite particles for ER and GER fluids having reduced sedimentation rates thereby eliminate arcing and caking phenomena.

The ER effect is a controllable solid-liquid phase transition phenomenon with a reversible response time <10 ms. Changes in the apparent viscosity of the fluids are dependent on the applied electrical field, and the resistance to motion of the fluid can be controlled by adjusting the applied electric field. Specifically, the effect is an electric field dependent shear yield stress with a yield point determined by the electric field strength.

Sedimentation is the separation of particles in suspension by gravitationally induced settling of the particles resulting in an area of a clear fluid and an area of slurry containing a higher concentration of particles.

The rate of sedimentation or the sedimentation rate is generally the correlation between sedimentation rate constants (overall sedimentation rate constant (Ko), sedimentation rate constant for constant rate period (Kc) and falling rate constant (Kf)).

According to the present subject matter, particles of a composite material are formed to produce an urea-coated nanoparticle composite. The composite is then suspended in an electrically insulating hydrophobic liquid (a high wetting insulated liquid) with a volume fraction of between 0.05 and 0.7.

The composite urea coated particles are metal salts of the form of oxalate and wherein the composite particles further include a polar molecule additive. Suitable metals include but are not limited to one or more of barium, rubidium and titanium.

The composite urea coated particles may further include a promoter selected from the group consisting of urea, butyramide and acetamide, and a poloxamer surfactant.

Polar molecule additives may be added to the high wetting insulating liquid or the urea coated nanoparticles or nanocomposite. Without being limiting in theory, the polar molecule additives generate polarization under certain circumstances. In the polarizations, there are electronic, ionic/non-ionic, and molecular polarizations generally occurring simultaneously to produce the ER effect.

Polar molecule additives according to the instant compositions and methods are capable of exhibiting an appropriate performance, such as low sedimentation rate, fast redispersibility, wide shear controllability range at a normal operation temperature range by improving flow properties of the GER fluid and preventing precipitation of nanoparticles. The polar molecule additive may be a surfactant. Specifically, the polar molecule additive may be, but not limited to, an anionic surfactant, a cationic surfactant, a nonionic surfactant, a weakly polar surfactant and mixtures thereof. Examples of surfactants include, but are not limited to urea, imidazolium compounds, sodium dodecanesulphonate, octadearyl dimethyl ammonium chloride, sodium dodecylbenzenesulfonate (SDBS), tween 80, span 80, Triton X-100, polyethylene glycol 400, triethylolamine, polaxomer and mixtures thereof. The surfactant may be weakly polar, such as for example, SDBS. Anionic surfactants may be, but are not limited to, imidazolium compounds, sodium dodecanesulphonate, sodium dodecyl sulfate, SDBS and mixtures thereof. Cationic surfactants may be, but are not limited to, octadearyl dimethyl ammonium chloride. Nonionic surfactant may be, but is not limited to, polysorbate 80, sorbitan monooleate 80, octyl phenol ethoxylate, triethylolamine, urea and mixtures thereof.

The polar molecule additive may comprise 0.1 to 10.0 w % of the nanocomposite. The polar molecule additive typically will comprise between 0.001 to 5 w % of the total fluid.

High wetting insulating liquids (dispersing or suspending phase or liquid) for use in the instant compositions and methods are those materials capable for use as non-conductive liquids. The liquid must have adequate stability within a normal operation temperature range 10-120° C. and a low viscosity, less than 1 Poise, when no electric field is applied. Specifically, the liquid must be capable of containing the metal salt nanocomposite. An ideal dispersing liquid material should have a high boiling point, high breakdown strength and good lubricating characteristics. Generally, the dispersing phase has a low dielectric constant and does not have much impact on the ER effect, apart from an influence on the response time of the ER fluid clue to its viscosity. In the case of GER fluids, the wetting characteristics between the solid particulates and the fluid are crucial to the ER effect. The particulate materials may be dispersed in a liquid mixture comprising two different dispersing phases in order to improve the stability and ER effect.

Examples of high wetting insulating liquids include, for example, oils with different terminal functional groups such as hydroxyl, methyl, or diglycidyl group. Oils include, but are not limited to, silicone oil, transformer oil, mineral oil, olive oil or mixtures thereof.

Before adding the polar molecule additive, nanocomposite particles are phase separated from the oil, The non-wetting phenomena results in large distances between nanocomposite particles even at high electric field. The polar molecule additive is added to produce induced wetting case, wherein the surface tension between the particles and oil is greatly reduced due to the mediating effect of the hydrophobic and hydrophilic components forming a web network in the particles with the oil bridging from the polar molecule additive, thus allowing the particles to disperse and to move close together upon the application of an electric field. Without being limiting in theory, the close contact between the particles and dispersion phase is a necessity for lower sedimentation rate.

The ER effect is apparent under 1-5 kV/mm. This transformation from liquid to solid may occur between 1 to 10 ms, and is reversible when the electric field is removed. For certain ER fluids the application of a strong field, generally in the range of 1-5 kV/cm, can lead to an anisotropic solid, with achievable yield stress in the order of over a couple of hundred KPa. As the change of the rheological properties is usually accomplished in less than 10 ms and is reversible, ER fluids can potentially function as an interface which translates electrical signals into mechanical motion, opening the possibility of actively controllable clutches, dampers, valves, locks, etc.

EXAMPLES

Example 1

Nanocomposite Particle Fabrication

Rubidium chloride is dissolved in distilled water and barium chloride is dissolved in distilled water. At the same time oxalic acid and polaxomer pluronic-123 are dissolved in a warm water bath. Titanium chloride is added slowly into the above mixture. The chloride solutions are mixed and treated in a warmed bath of oxalic acid and poloxamer pluronic-123, while the urea is added to form a white colloid which is then cooled down to room temperature. After washing and filtering, the precipitant is dried. The precipitant contains the urea-coated metal salt nanoparticles.

Example of Urea Coating

Example 2

Addition of Polar Molecule Additive

The particles of Example 1 are combined with SDBS in an amount of 0.2 to 5 wt % SDBS. The mixture is ground in a ball milling machine for 30 minutes, followed by (ultra)sonification with maximum power for one hour at 20 to 40° C. The mixture is processed under vacuum freeze drying machine for 12 h to remove any excess water. The various surfactant GER fluids are then tested for various characteristics.

Figure 1B:
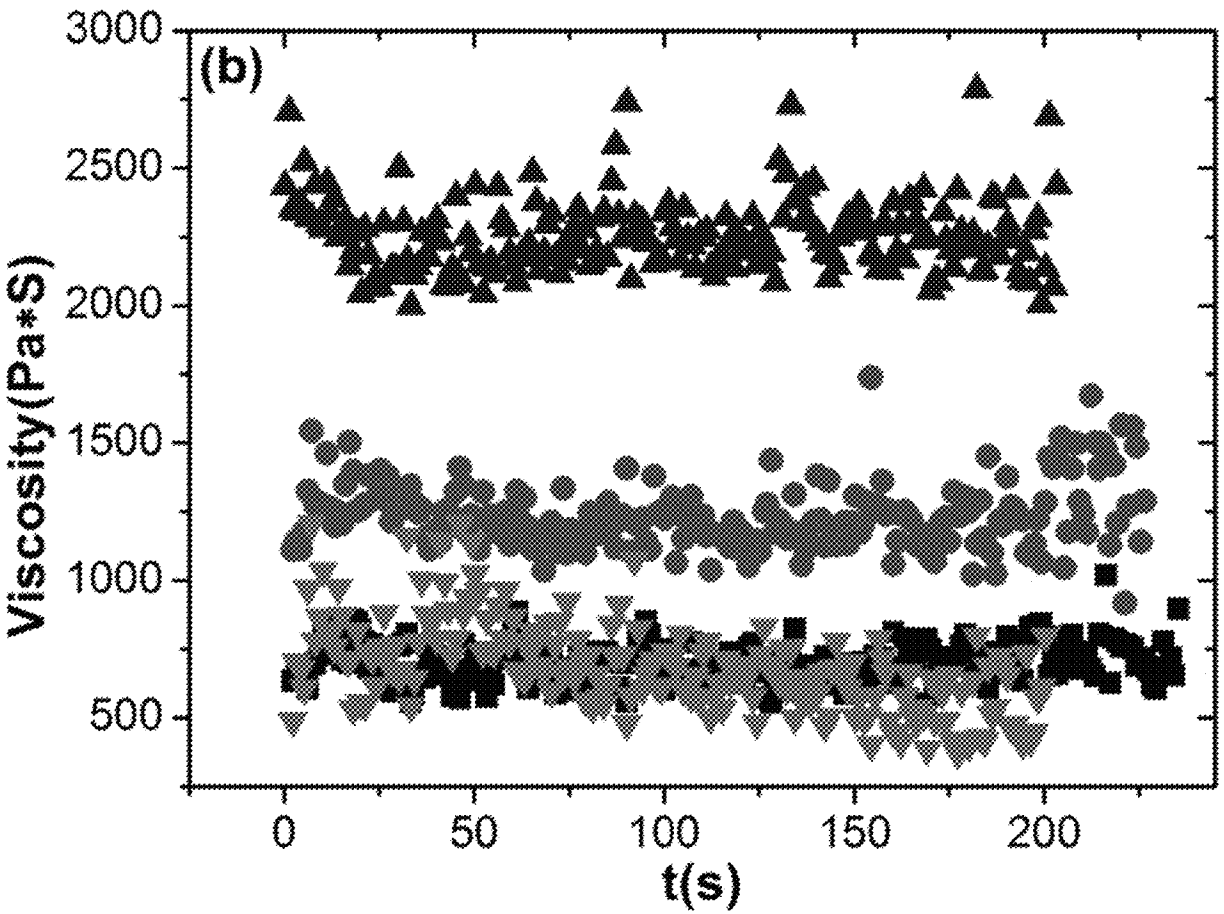
Figure 1C:
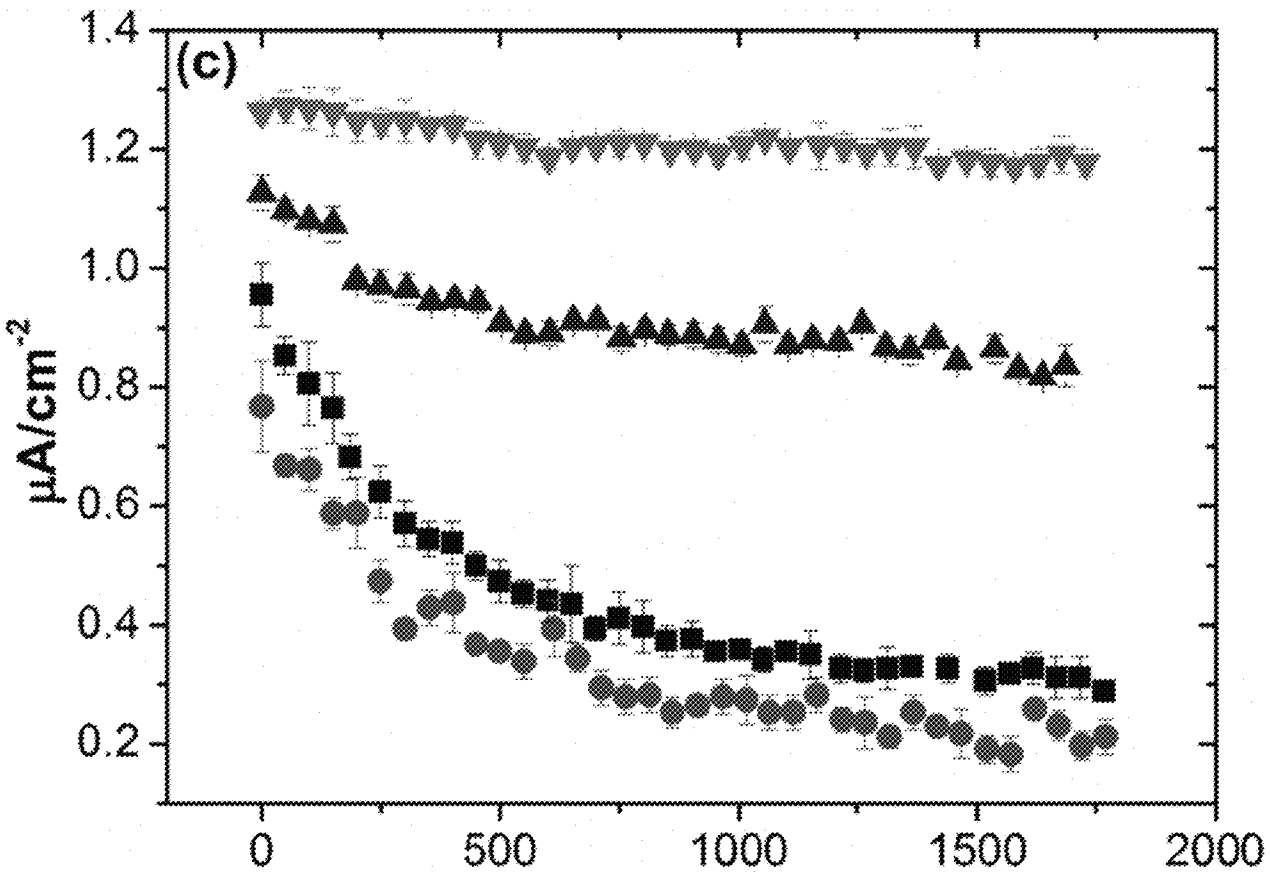

FIG. 1 (*a*) depicts the dynamic yield stress under an external applied field of 1 KV/mm with angular velocity $\dot{\gamma}$=0.1 rad/s. Here ♦ is for sample with 0.2 wt % SDBS addition, ▪ is for sample with 1 wt % SDBS addition, ▲ is for sample with 5 wt % SDBS addition, ♥ is for sample with no surfactant addition. FIG. 1 (*b*) depicts viscosity measured with no external field applied under velocity $\dot{\gamma}$=0.1 rad/s. FIG. 1 (*c*) depicts current density under an external applied field 1 KV/mm with angular velocity $\dot{\gamma}$=0.1 rad/s.

In contrast to conventional understanding, e.g. that current density is proportional to yield stress, it is demonstrated by the method of adding SDBS to the GER fluid, high dynamic yield stress with low current density is achieved. Without being limiting in theory, SDBS may increase the dielectric constant of the urea-coated nanoparticles, which may be the reason for the increased ER effect. In addition, the improved sedimentation stability may further contribute to the increased yield stress due to the particle settling may compete with chain-like structure formation under electric field. An unexpected observation is the non-monotonous relation between current density and the weight percentage of SDBS addition. This may be attributed to the competing effects between the low mobility organic components and high mobility sodium ions. At high surfactant concentration, the conductive surfactant inter-particle bridges may form, leading to an increased current.

Example 3

Sedimentation

Figure 3:
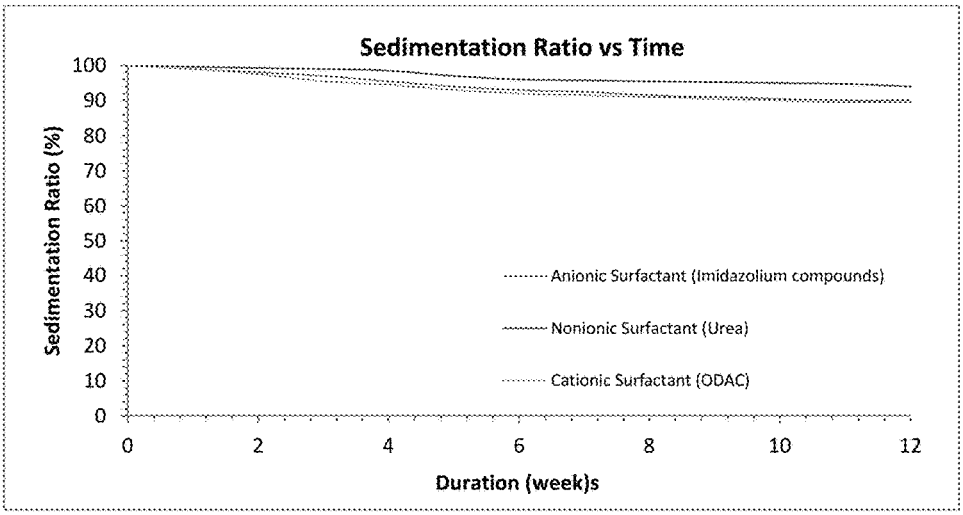
FIG. 3 depicts sedimentation effects of electrorheological fluid with various types of additives (1 wt %).(Moved to Ex. 3)

The experimental results shown in FIG. 3 are illustrative of a ER fluid comprising various additives, such as 1 wt % of urea, anionic surfactant, cationic surfactant and nonionic surfactants, respectively. These were prepared and tested at boundary water of 0.1 wt %, with insulating liquid at a weight fraction of 0.5, to determine sedimentation rates. Comparing the data of FIG. 3, it is shown that the performance of the ER fluid is lowered as the amount of additives increase. The sedimentation rates observed were greatly improved as compared to the sedimentation rate of GER particles with no additives. See, Li et al. (Giant Electrorheological Fluid Comprising Nanoparticles: Carbon Nanotube Composite, J. Appl. Phys. 107, 093507 (2010)) found more than 50% sedimentation in just one day.

Example 4

Stability

The samples from Example 3 were tested for stability. Each was placed on a shelf for one week. It was found that only the original GER sample showed distinct phase separation, while the SDBS addition samples showed no difference.

Figure 2A:
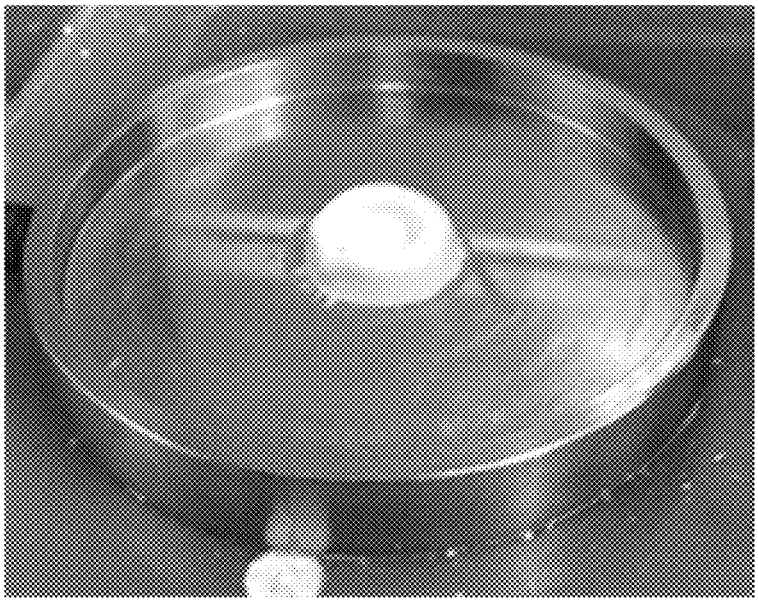
FIG. 2 (*a*) depicts a sample with SDBS addition after 10 hours of rotation with an angular speed of $\dot{\gamma}$=0.4 rad/s.
Figure 2B:
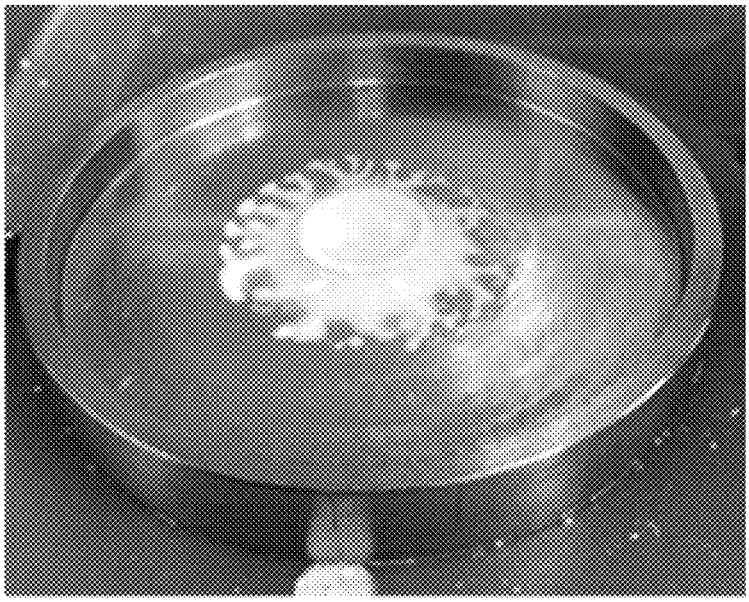

To further test stability, the samples from Example 3 were put under 10 hours of rotation with angular speed of $\dot{\gamma}$=0.4 rad/s. In FIG. 2(*a*), a big difference was found. The original giant ER fluid is more apt to phase separate. In FIG. 2(*b*), it is clearly seen that the more dilute phase in the sample with no SDBS addition has been separated from the more dense phase under centrifugal force.

With the information contained herein, various departures from precise description of the present subject matter will be readily apparent to those skilled in the art to which the subject matter pertains, without departing from the spirit and the scope of the present subject matter claimed below. The present subject matter is not to be considered limited in scope to the procedures, properties or components defined, since the preferred embodiments and other descriptions are intended only to be illustrative of particular aspects of the presently provided subject matter. Indeed, various modifications of the described modes for carrying out the present subject matter which are obvious to those skilled in related fields are intended to be within the scope of the following claims.

What is claimed is:

1. A method for preparing giant electrorheological (GER) fluids, comprising the steps of:

grinding a nanoparticle composite comprising urea and 0.2-5.0 wt % sodium dodecylbenzenesulfate (SDBS);

agitating the ground composite via ultrasonification for at least 30 minutes at 20-40° C.;

drying the composite for at least 12 hours in a freeze drying machine; and suspending the composite in a non-conducting oil.

2. The method for improving GER fluids of claim 1, wherein the weight fraction of SDBS to GER fluid is from about 0.1 to about 1 w %.

3. A method for preparing giant electrorheological (GER) fluids comprising:

preparing urea-coated metal salt nanoparticles;

grinding a composite consisting of the urea-coated metal salt nanoparticles and 0.2-5.0 wt % sodium dodecylbenzenesulthte (SDBS);

agitating the ground composite via ultrasonification for at least 30 minutes at 20-40° C.;

drying the agitated composite for at least 12 hours in a freeze drying machine; and suspending the agitated, ground composite in a non-conducting oil.

* * * * *